US008434551B2

(12) United States Patent
Nenniger et al.

(10) Patent No.: US 8,434,551 B2
(45) Date of Patent: May 7, 2013

(54) METHOD OF CONTROLLING GROWTH AND HEAT LOSS OF AN IN SITU GRAVITY DRAINING CHAMBER FORMED WITH A CONDENSING SOLVENT PROCESS

(75) Inventors: John Nenniger, Calgary (CA); Lowy Gunnewiek, Calgary (CA)

(73) Assignee: N-Solv Corporation, Calgary, Alberta (CA)

( * ) Notice: Subject to any disclaimer, the term of this patent is extended or adjusted under 35 U.S.C. 154(b) by 417 days.

(21) Appl. No.: 12/567,175

(22) Filed: Sep. 25, 2009

(65) Prior Publication Data

US 2011/0073302 A1 Mar. 31, 2011

(30) Foreign Application Priority Data

Sep. 26, 2008 (CA) ..... 2639851

(51) Int. Cl.
*E21B 43/24* (2006.01)

(52) U.S. Cl.
USPC ..... 166/272.1

(58) Field of Classification Search ..... None
See application file for complete search history.

(56) References Cited

U.S. PATENT DOCUMENTS

| | | | | |
|---|---|---|---|---|
| 4,488,598 | A * | 12/1984 | Duerksen | 166/252.4 |
| 5,771,973 | A * | 6/1998 | Jensen et al. | 166/303 |
| 5,860,475 | A * | 1/1999 | Ejiogu et al. | 166/245 |
| 5,899,274 | A * | 5/1999 | Frauenfeld et al. | 166/401 |
| 6,883,607 | B2 | 4/2005 | Nenniger et al. | |
| 7,363,973 | B2 | 4/2008 | Nenniger et al. | |
| 7,514,041 | B2 | 4/2009 | Conquorgood et al. | |
| 7,727,766 | B2 | 6/2010 | Nenniger et al. | |
| 2003/0015458 | A1 * | 1/2003 | Nenniger et al. | 208/428 |
| 2003/0141053 | A1 * | 7/2003 | Yuan et al. | 166/248 |
| 2005/0145383 | A1 * | 7/2005 | Nenniger et al. | 166/272.7 |
| 2005/0211434 | A1 * | 9/2005 | Gates et al. | 166/272.3 |
| 2010/0163229 | A1 | 7/2010 | Nenniger | |

FOREIGN PATENT DOCUMENTS

| | | | |
|---|---|---|---|
| CA | 2235085 | C | 10/1999 |
| CA | 2567399 | C | 10/1999 |
| CA | 2633061 | A1 | 2/2000 |
| CA | 2299790 | A1 | 8/2001 |
| CA | 2299790 | C | 8/2001 |
| CA | 2351148 | A1 | 12/2002 |
| CA | 2351148 | C | 12/2002 |
| CA | 2374115 | C | 9/2003 |
| CA | 2436158 | A1 | 1/2005 |
| CA | 2549614 | A1 | 12/2007 |
| CA | 2552482 | A1 | 1/2008 |

(Continued)

OTHER PUBLICATIONS

U.S. Appl. No. 12/308,082, filed Jun. 5, 2007 (Same as publication #2010-0163229).

*Primary Examiner* — Terry Melius
*Assistant Examiner* — Silvana Runyan
(74) *Attorney, Agent, or Firm* — Vidas, Arret & Steinkraus P.A.

(57) ABSTRACT

A solvent based gravity drainage process whereby the vertical growth rate of the chamber is restricted by placing, monitoring and managing a buoyant gas blanket at the top of the vapor chamber. The process reduces the heat loss to the overburden as well as providing a means to preserve a barrier layer of bitumen saturated reservoir sand at the top of the pay zone in reservoirs where there is limited or no confining layer present.

21 Claims, 9 Drawing Sheets

FOREIGN PATENT DOCUMENTS

| | | | |
|---|---|---|---|
| CA | 2591354 | A1 | 12/2008 |
| CA | 2639851 | A1 | 3/2010 |
| CA | 2688937 | A1 | 6/2011 |
| CA | 2707776 | A1 | 12/2011 |

* cited by examiner

METHOD OF CONTROLLING GROWTH AND HEAT LOSS OF AN IN SITU GRAVITY DRAINING CHAMBER FORMED WITH A CONDENSING SOLVENT PROCESS

FIELD OF THE INVENTION

This invention relates generally to the field of in situ hydrocarbon extraction and more particularly to in situ extraction of hydrocarbons by means of a condensing solvent process which mobilizes the hydrocarbons for extraction by, for example, gravity drainage.

BACKGROUND OF THE INVENTION

Tar sands or oil sands such as are found in Canada, contain vast reserves of hydrocarbon resources of the type referred to as heavy oil or bitumen. Such heavy oil or bitumen is a hydrocarbon that has a high specific gravity and viscosity. These properties make it difficult to extract the hydrocarbon from the tightly packed sand formations in which it is found because unlike lighter oil deposits, heavy oil and bitumen do not readily flow at in situ conditions.

In prior Canadian Patent No. 2,299,790, a condensing solvent based in situ hydrocarbon recovery process is disclosed. This patent teaches, among other things, using a condensing solvent and controlling the in situ pressure to achieve a condensation temperature for the solvent within the formation which is suitable for reducing a viscosity of the in situ hydrocarbon by warming and solvent effects so that the hydrocarbon will flow under the influence of gravity. The result of this process is a volume in the formation which is stripped of the mobilized hydrocarbons, and which is called a gravity drainage chamber. As more solvent is circulated more hydrocarbon is removed resulting in a chamber which grows upwardly and outwardly from the injection well.

Canadian Patent No. 2,351,148 teaches, among other things, using a solvent which has been purified sufficiently to allow the solvent to achieve bubble point conditions at the extraction interface of the gravity drainage chamber whereby non-condensable gases naturally arising from the warming bitumen or hydrocarbon will be carried away with the draining liquids also in liquid form. In this way, a continuous extraction process is achieved at the extraction interface, because the potential impediment of an insulating layer of non-condensable gases existing between the incoming condensing solvent and the extraction interface is removed as part of the process.

The geological characteristics of the tar sands or oil sands can vary from deposit to deposit. While some deposits are relatively thick deposits in the order of 40 to 50 or more meters thick, many deposits are relatively thin being less than 20 meters thick and in many cases even 10 meters or less thick. In addition, the characteristics of the overburden can vary considerably. In some cases, the overburden is comprised of the cap rock which can act as a containment layer, but in other cases the overburden may be a sand layer or gravel or other porous material that provides poor confinement.

Where good confinement is available it is preferred to let the chamber grow to all the way to the overburden layer to extract all of the available hydrocarbon, but, leaving the overburden exposed to condensing solvent in the chamber is undesirable. More specifically, the overburden will continue to attract condensing solvent and the latent heat of condensation of such condensing solvent will be passed to the overburden but to no useful extraction effect. There is simply no hydrocarbon located in the overburden which can be warmed and removed. Therefore, any heat transfer to the overburden layer is wasted, thereby reducing the efficiency of the condensing solvent process.

In some cases, the overburden layer may not be a good confinement layer. In cases where the overburden layer is sand or other porous material it may also be saturated with water. In such a case, if the chamber growth extends vertically to the overburden layer the water will be provided with a pathway into the chamber which could result in the chamber being water flooded. Once the chamber is water flooded, further extraction from the chamber through a condensing solvent process is unlikely. Thus, when poor confinement exists it is preferred to stop vertical chamber growth at a point below the overburden layer to preserve a layer of hydrocarbon to that provides the necessary confinement.

SUMMARY OF THE INVENTION

What is desired is a method of controlling the location in the gravity drainage chamber where the solvent condensation occurs to control the flow of heat and chamber growth in a condensing solvent process to more efficiently extract in situ heavy oil and bitumen from an oil sand deposit under an overburden layer. In other words, it is desirable, in some circumstances, to preserve the integrity of a layer of bitumen saturated sand at the top of the reservoir in order to provide a confining barrier for the extraction chamber. In other circumstances it is desirable to control the location of condensation in the extraction chamber in order to maximise the thermal efficiency of the condensing solvent process.

According to the present invention the growth of the extraction chamber in situ can be controlled through the accumulation of non-condensable gases within the extraction chamber that act as a thermal barrier between the condensing solvent on a warm side of said layer, and the overburden or unextracted bitumen on a cold side of said layer. The vapour density of the non-condensable barrier gas, relative to the vapour density of the solvent vapour, at in situ or extraction conditions can be selected to optimize chamber growth and improve extraction effectiveness. By accumulating non-condensable gases having a vapour density which is less than the vapour density of the condensing solvent at extraction conditions, the barrier layer can be preferentially located or floated to a top or attic of a gravity drainage chamber. In this manner, vertical heat flow and vertical chamber growth can be restricted when desired, without stopping continued chamber growth in other directions, such as horizontally along a bitumen layer. By limiting vertical heat flow and vertical growth while encouraging horizontal growth, the horizontal wells may be spaced within the layer to optimise capital costs.

According to a preferred aspect of the current invention, a relatively pure solvent can be used to commence initial extraction of hydrocarbons in situ to form an extraction chamber. According to the invention of U.S. Pat. No. 2,351,148 the purer the solvent the more non-condensables can be removed from the extraction chamber. Most preferably, the removal of heat transfer poisoning non-condensable gases, which arise for example, from the mobilization and extraction of the reduced viscosity hydrocarbons will occur at a rate that prevents non-condensable gas from accumulating within the extraction chamber, thereby permitting continued chamber growth to occur.

According to the present invention, the vertical heat flow and vertical growth of the chamber can be measured over time and at a time at or before the vertical growth reaches the top of the bitumen layer, i.e., reaches to the overburden layer, the solvent purity can be temporarily varied to permit non-condensable barrier gas to accumulate in the chamber. The non-condensable barrier gas can arise either naturally from the bitumen which is being warmed and extracted, or, can be specifically added to the solvent to be carried to the extraction surface by the solvent within the chamber and may be one or more than one species of non-condensable gases.

Therefore, according to one aspect of the present invention there is provided a method of forming an in situ gravity drainage chamber while extracting hydrocarbons from a hydrocarbon bearing formation, the method comprising:

a. Injecting a condensing solvent which is sufficiently pure, having regard to the in situ conditions, to extract non-condensable gases from said chamber in liquid form;
b. Monitoring a growth of said chamber in a vertical direction; and
c. Establishing a non-condensable barrier gas layer at a top of said chamber to reduce the vertical heat flow and vertical growth rate of said chamber at or before said chamber reaches an overburden layer.

According to a further aspect of the invention there is provided a method of forming an in situ gravity drainage chamber in a hydrocarbon bearing formation comprising injecting a condensing solvent into said formation and varying a solvent purity over time to cause enough of a barrier gas to be introduced into said chamber to halt vertical growth of said chamber.

BRIEF DESCRIPTION OF THE DRAWINGS

Reference will now be made to preferred embodiments of the present invention, by way of example only, and in which.

DETAILED DESCRIPTION OF THE PREFERRED EMBODIMENTS

Figure 1:
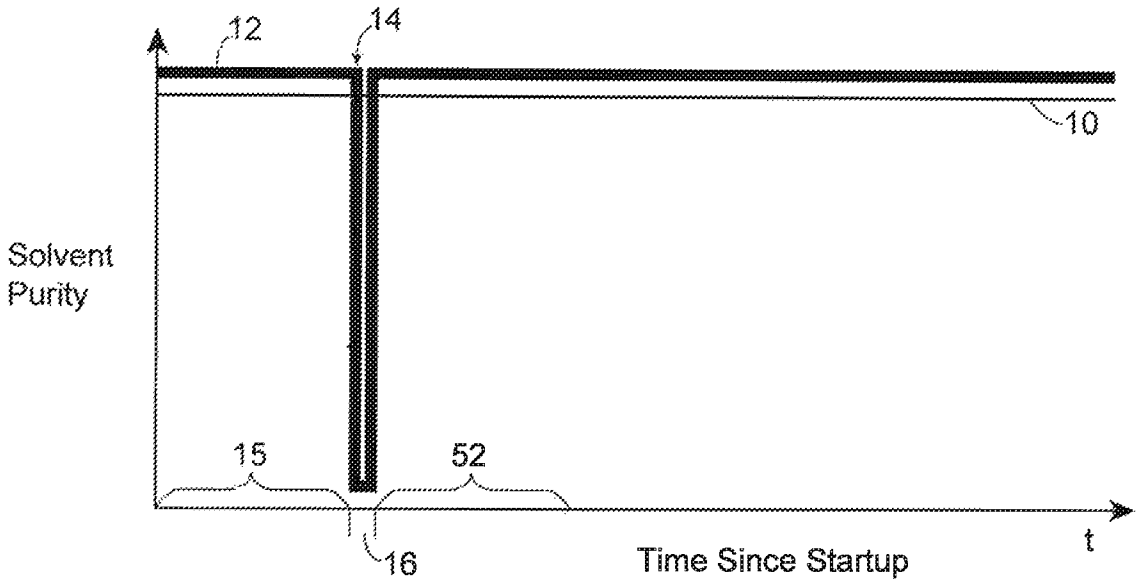
FIG. 1 shows a schematic of solvent purity of injected solvent over time according to one aspect of the present invention.

In FIG. 1, a time line schematic is provided that generally illustrates the trends of purity of the injected condensing solvent over time according to a first aspect of the present invention. The horizontal or x-axis represents time, and the vertical or y-axis represents solvent purity. A horizontal denoted line 10 is also shown, which represents a desired purity of the solvent which is capable of extracting hydrocarbons and bitumen from the formation. This purity is referred to here in as extraction purity since at this purity hydrocarbon extraction occurs. Extraction purity means a solvent that is pure enough to continuously remove non-condensable gases from the chamber. The precise solvent purity required for extraction purity will vary from reservoir to reservoir depending upon in situ conditions such as pressure, temperature and amount of non-solvent gas naturally present and dissolved into the bitumen.

Also shown is an injected solvent purity line 12, which represents the purity of the injected condensing solvent over time. For efficient non-condensable gas removal the extraction purity is able to achieve bubble point conditions for the condensing solvent at the extraction interface in the chamber. To achieve effective chamber growth rates, it is most desirable to remove any such expressed non-solvent gases, which are non-condensable at extraction conditions, from the chamber. At extraction purity for the solvent such other gases are able to dissolve into the solvent condensing onto the bitumen interface to permit these other gases to be carried away in a liquid form out of the chamber.

As fresh solvent is continually injected into the extraction chamber, it condenses onto and mobilizes the bitumen, scavenges other non-solvent gases present and results in a liquid mixture of solvent and hydrocarbons and other liquids draining down the chamber walls to collect in the bottom of the extraction chamber. From there the liquids are lifted or pumped to the surface for separation of solvent and hydrocarbons and then purification and preferably reuse of the solvent in the formation. Over time the extraction chamber will grow as more solvent is circulated and more hydrocarbon and bitumen is produced. Provided that the bubble point conditions are achieved at the interface, due to the solvent being at extraction purity, the chamber will grow outwardly both horizontally and vertically without undue accumulations of non-condensable gases occurring within the chamber. As the chamber grows, the vertical growth will eventually reach a point where it is at or near the overburden, or at a maximum desired vertical height.

According to the present invention, it is desirable to monitor the vertical growth of the chamber to be able to identify when the vertical growth is at or near the overburden layer or more specifically at an optimum height. This, according to the present invention, is the time to preferentially reduce and restrict further vertical growth. The preferred means used to measure vertical growth of the chamber of the present invention is discussed in more detail below.

Figure 2:
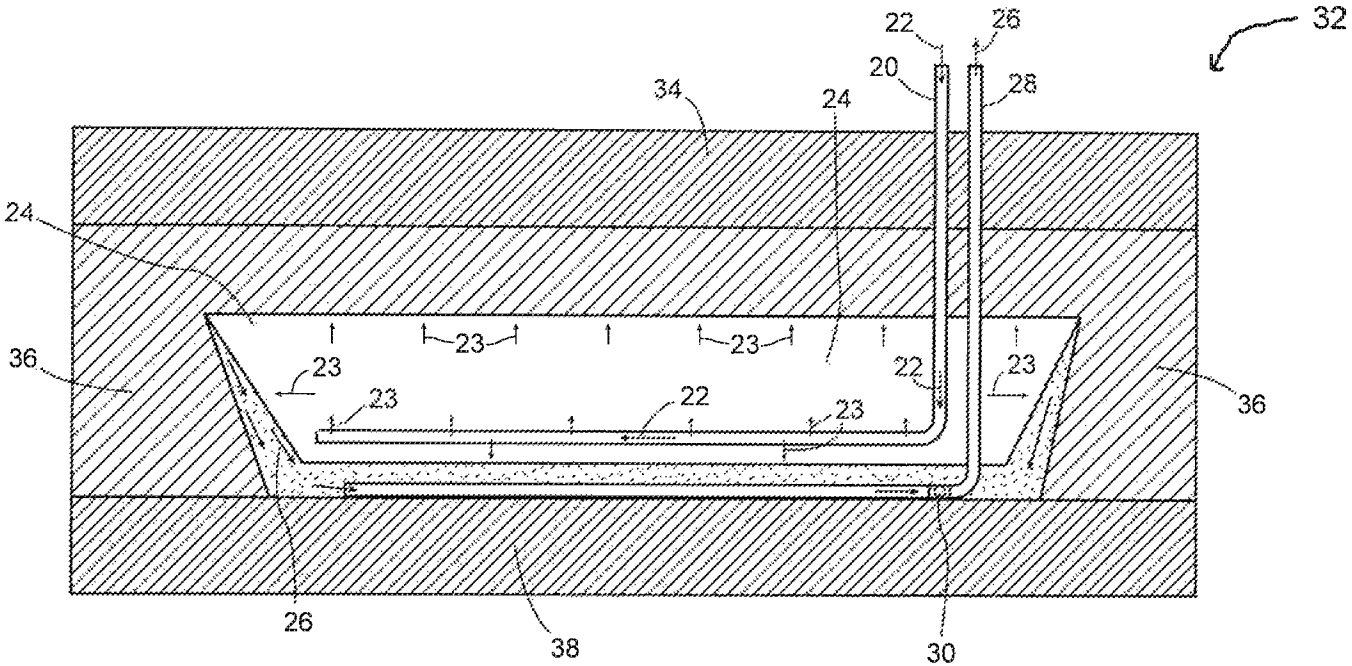
FIG. 2 shows an extraction chamber being extracted during an initial stage with substantially pure solvent according to the present invention.

FIG. 2 shows an injection well 20 with extraction purity condensing solvent being injected (arrows 22) during an initial time period 15 (FIG. 1). The condensing solvent 22 exits the injection well 20 into an extraction chamber 24 where it is shown flowing by convection outwardly as arrows 23. It condenses on the extraction interface and results in draining liquids 26 which drain down the sides of the chamber 24 under the influence of gravity. These liquids 26 enter the production well 28, and are pumped to the surface by a pump 30. The hydrocarbon bearing formation 32 includes an overburden layer 34, a hydrocarbon pay zone 36, and an underburden 38. FIG. 2 depicts the chamber at a point in time towards the end of the time period 15 of FIG. 1.

While FIG. 2 and the other figures depict horizontal well pairs it will be understood that the wells need not be truly horizontal and may be sloped or the like. Thus the term horizontal as used herein means somewhat or generally horizontal. Further other well configurations are contemplated by the present invention, such as a generally vertical single well arrangements or configurations of multiple generally horizontal wells.

As can now be understood, during this part of the process (time period 15) the solvent has extraction purity and gases other than the solvent gas, which are noncondensable at the condensing conditions for the solvent, are being removed from the chamber 24 at a rate which permits extraction to continue. In other words, these other gases are not allowed to accumulate in the chamber to any significant degree during this step in the process and thus are not present in FIG. 2. Time period 15 ends when the extraction chamber has reached its desired maximum height.

Once the maximum chamber height is reached, the present invention provides that the solvent purity of the injected condensing solvent is changed. This is shown in FIG. 1, at 14. At this point, it is desirable to reduce the solvent purity and introduce more non-condensable barrier gas into the chamber, in other words the injection solvent purity is no longer at extraction purity. The change in injection solvent purity will have two in situ effects according to the present invention. The first effect is that more non-condensable barrier gas will be carried into the chamber by the solvent itself and then concentrated at the condensation surfaces as the solvent condenses. The second effect is that the condensed liquid solvent leaving the chamber is less able to extract the non-solvent gases arising naturally in the formation as liquids as the solvent is somewhat or fully saturated with barrier gases already. Depending upon how far below extraction purity the solvent is it can only scavenge barrier gases from the chamber at a reduced rate, if at all. As a result, non-solvent barrier gases now begin to accumulate within the chamber, at the condensation surfaces, over the time period 16 of FIG. 1.

According to the present invention the preferred non-solvent barrier gas is a light gas having a vapour density which is most preferably significantly lower than the vapour density of the solvent at extraction or in situ conditions. The density difference should be sufficient, at the extraction chamber temperature and pressure to permit the barrier gas to accumulate at a preferred location in the chamber, such as at the roof of the chamber as described below.

Figure 3:
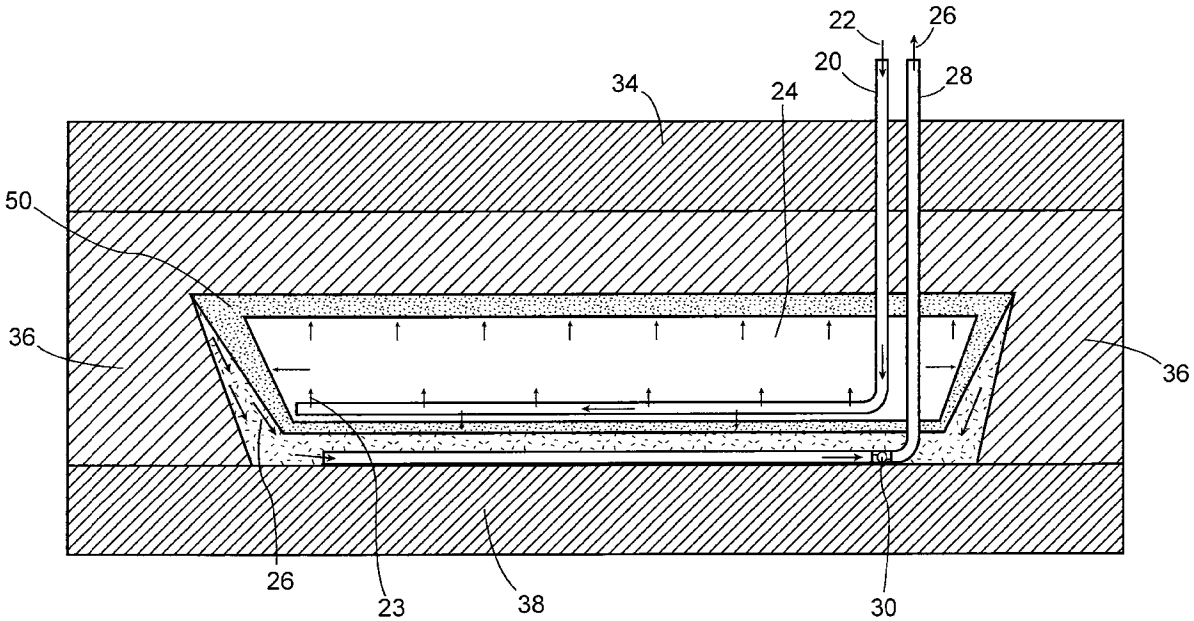
FIG. 3 shows the chamber of FIG. 2 at a later stage of extraction where the vertical growth of the chamber has reached a desired upper limit and a barrier gas is being accumulated in the chamber at the extraction (condensation) interfaces.

FIG. 3 shows the in situ conditions in the extraction chamber corresponding to the end of the time period 16 on FIG. 1. As shown in FIG. 3, as the condensing solvent carries the non-condensable or barrier gas into the formation where it will be released at the extraction interface around the perimeter of the chamber when the solvent condenses. The barrier gas will, over time, build up as a relatively thick barrier layer 50 on all of the surfaces on which the condensing solvent is condensing.

Figure 4:
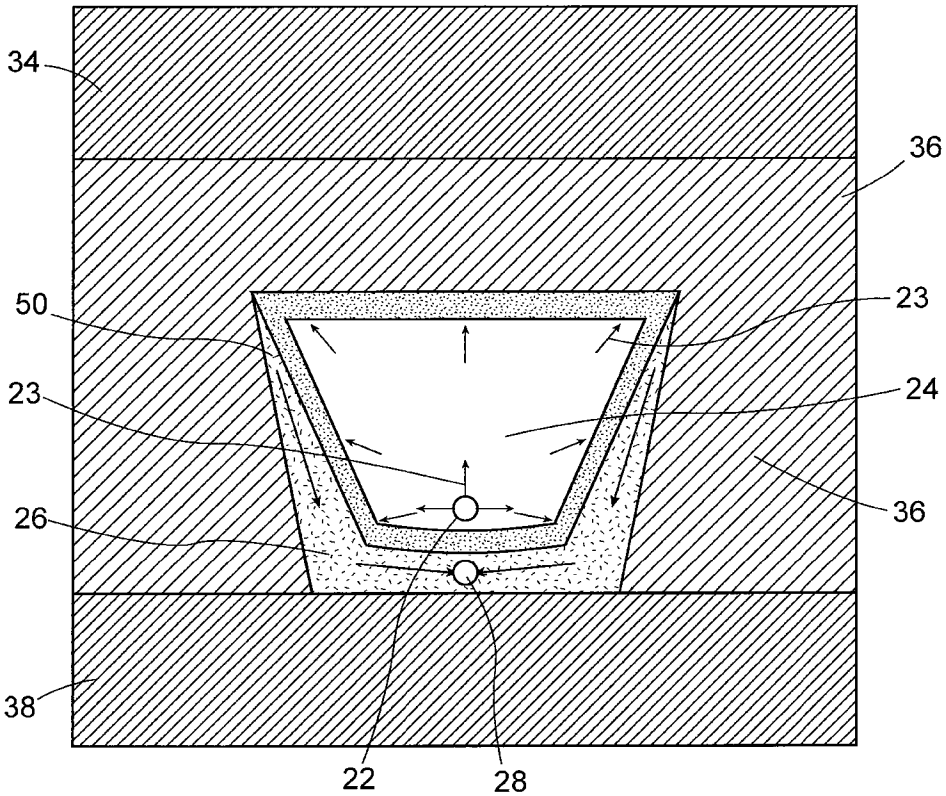
FIG. 4 is a different cross section view of the chamber of FIG. 3

FIG. 4 is a different cross-sectional view of FIG. 3 and like numbers are used for like elements. Again the barrier gas layer can be seen on all of the condensing surfaces. At a certain point enough noncondensable gas has been allowed to accumulate in the chamber to form the desired barrier layer.

Turning back to FIG. 1, during the time period 16, the purity of the condensing solvent has been decreased to introduce an appropriate amount of barrier gas into the extraction chamber. The appropriate amount will depend upon the size of the chamber and the rate of extraction and will vary from chamber to chamber. However, for the purposes of this specification, it will be understood that an appropriate amount means an amount that will permit the barrier gas to accumulate in the chamber and form a barrier layer.

Figure 5:
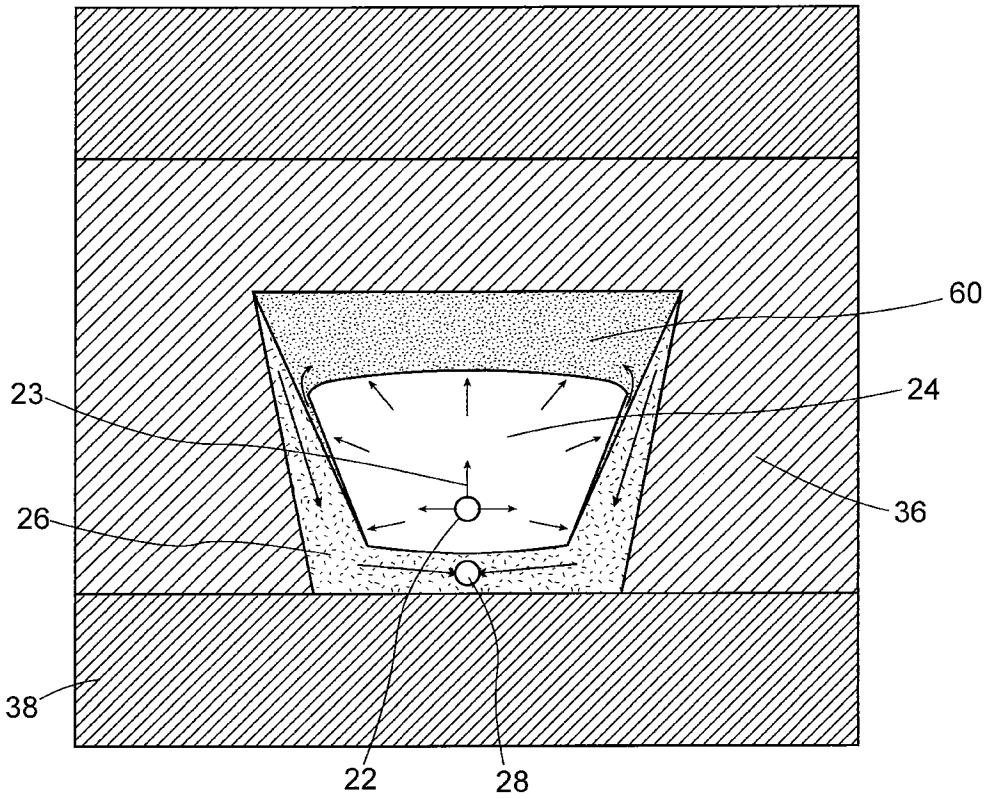
FIG. 5 is a subsequent cross-section view similar to FIG. 4; showing that after a period of time, the barrier gas floats up towards the top of the chamber and begins to accumulate there.

FIG. 5 is later in time than FIGS. 3 and 4 and depicts a transition period represented by the time span 52 in FIG. 1. The solvent purity of the injected solvent has been changed again and the solvent is now at extraction purity again. In FIG. 5 the accumulated non-solvent barrier gases are shown moving towards the top of the chamber since they are less dense than the condensing solvent vapour. Eventually the non-condensable gases will accumulate and be confined to a layer which is floating at the top of the chamber into a relatively thicker layer 60.

Figure 6:
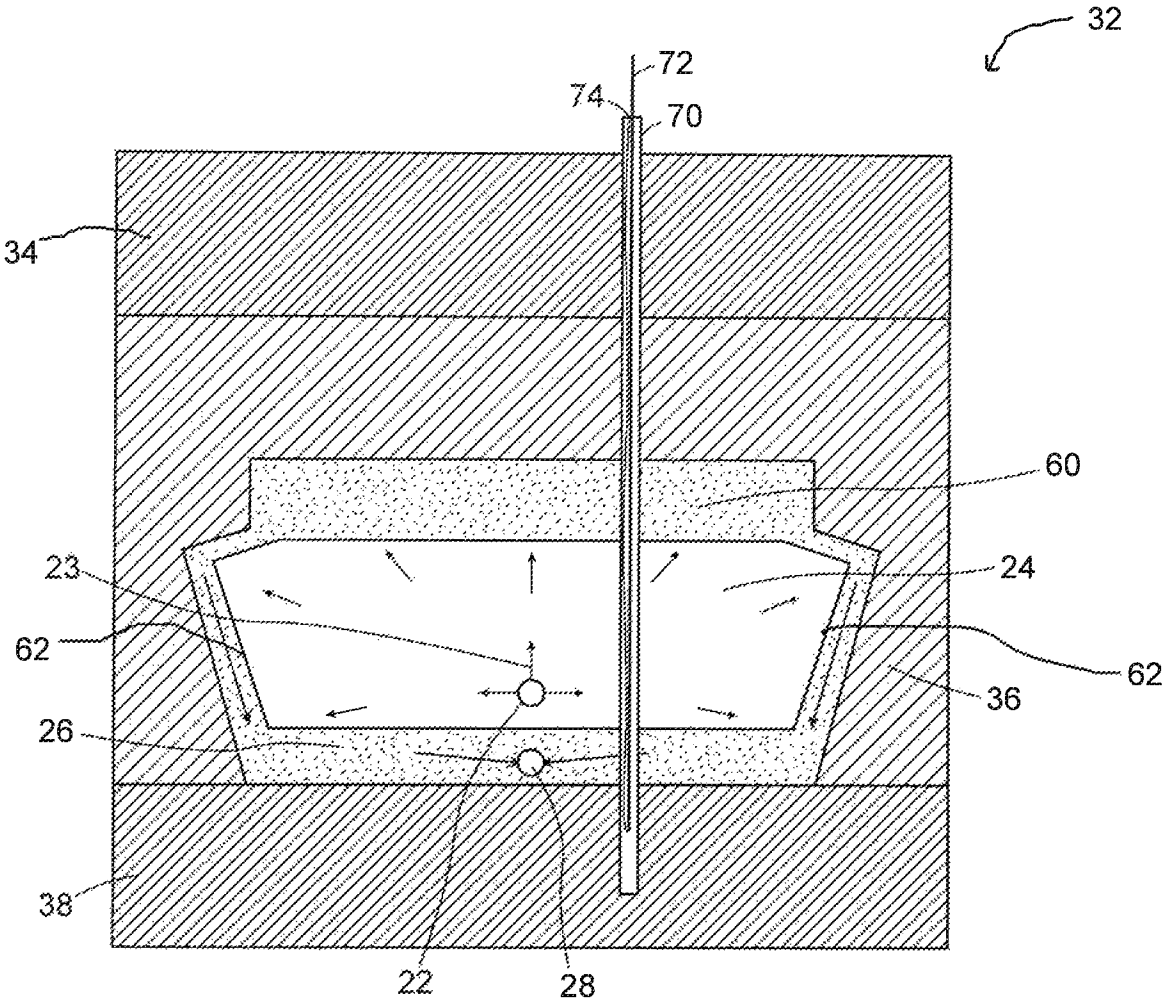
FIG. 6 is the chamber of FIGS. 3 and 4 after a further period of time under substantially pure condensing solvent injection showing the continued horizontal extraction or growth of the chamber but very limited vertical growth according to the present invention.

FIG. 6 shows the effect of the continued steady state extraction, further along in time period 52 of FIG. 1. As can be seen the barrier layer 60 is restricting further vertical growth and vertical heat loss, while the absence of a barrier layer on the vertical surfaces of the chamber is permitting further horizontal growth of the chamber at 62.

It can now be appreciated that the present invention provides a solution to both undesirable effects of having a chamber grow uncontrolled into the overburden layer. Firstly, the non-condensable barrier gas layer will prevent heat loss through the top of the chamber. This will permit more heat to be contained within the chamber and directed usefully to heating the bitumen at the extraction interfaces for continued horizontal extraction. Secondly, the presence of the barrier gas or insulating layer will prevent the extraction interface from continuing to grow upwardly limiting vertical chamber growth. In this manner, the chamber can be prevented from being flooded, for example from an overlying water layer. At the same time, a continued extraction can occur in the horizontal directions by means of the solvent which is at extraction purity. According to an alternate embodiment of the present invention during the time period 16 (after point 14) the solvent injection could stop altogether, to be temporarily replaced with an injection of an amount, preferably a defined amount, of non-solvent barrier gas. Thus the schematic of FIG. 1 is also intended to comprehend that solvent injection may temporarily halt at point 14 in order to permit a volume of non-condensable gases to be injected over a short period of time. Injection of the non-condensable gases then ceases and thereafter continued solvent extraction through use of extraction purity solvent can recommence. Convection flow will carry the barrier gases outwardly and distribute the barrier gas around the perimeter of the chamber on the condensing surfaces.

Although many different gases are comprehended by the present invention as the barrier gas, when the solvent gas is propane, the preferred barrier gas is one or more of helium, hydrogen, methane or ethane. Methane is desirable because it is naturally occurring and typically in abundance at the extraction site and has a low vapour density relative to propane. It will therefore tend to rise to the top of the chamber and form a barrier layer. Helium and hydrogen are desirable in that each is also a light gas which can be easily obtained and introduced in the chamber as needed to provide buoyancy. Other barrier gases are also comprehended by the present invention provided they meet the vapour density criteria of being able to rise within and remain above the solvent gas. In this specification the term solvent gas is meant to comprehend many different solvents, such as propane, ethane, butane, and the like. The choice of the condensing solvent will depend upon the reservoir conditions. According to the present invention, the choice of barrier gas will be one that is less dense than the selected solvent gas at reservoir conditions.

Figure 7:
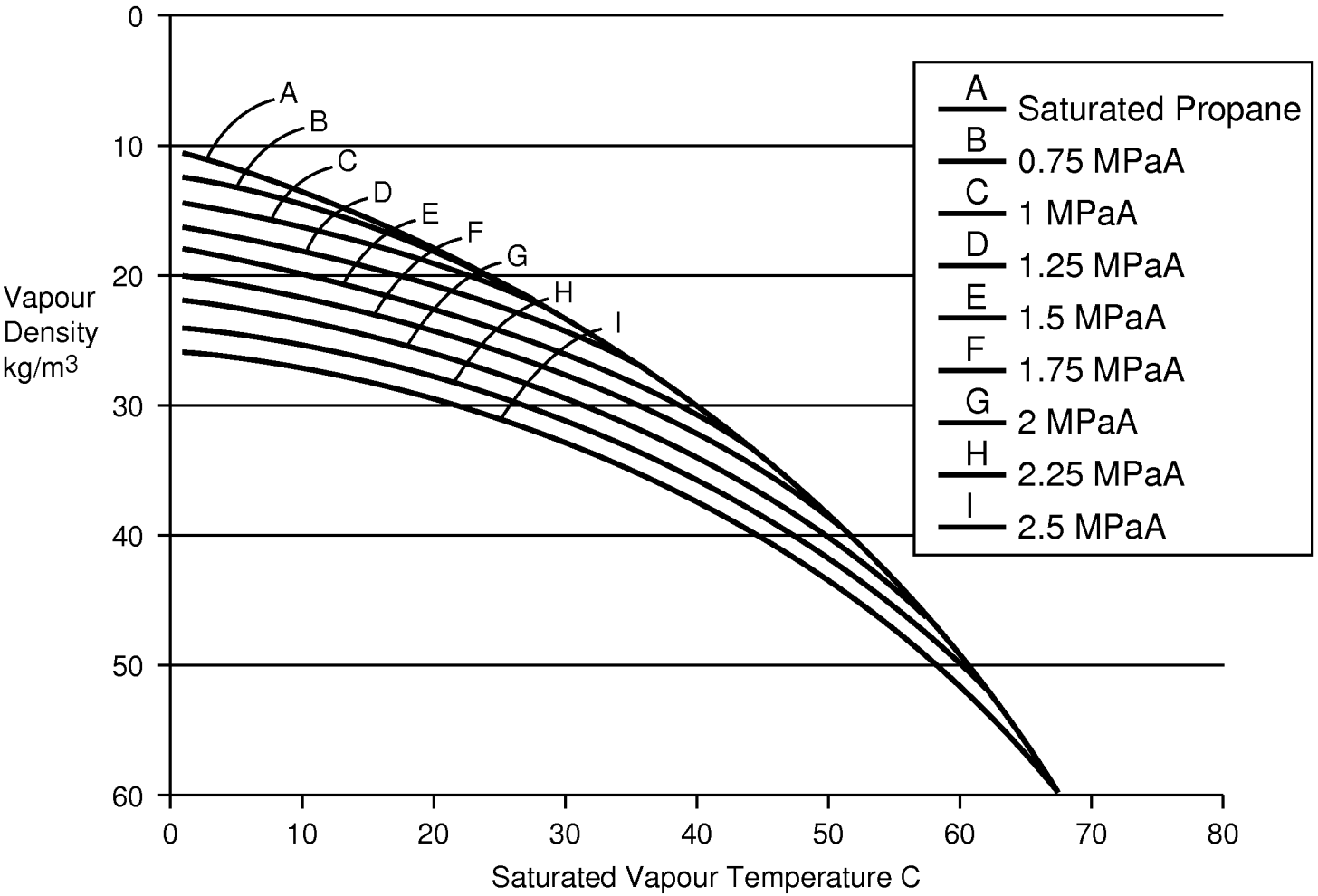
FIG. 7 shows a buoyancy curve of methane in propane at various pressures and saturation temperatures.
Figure 8:
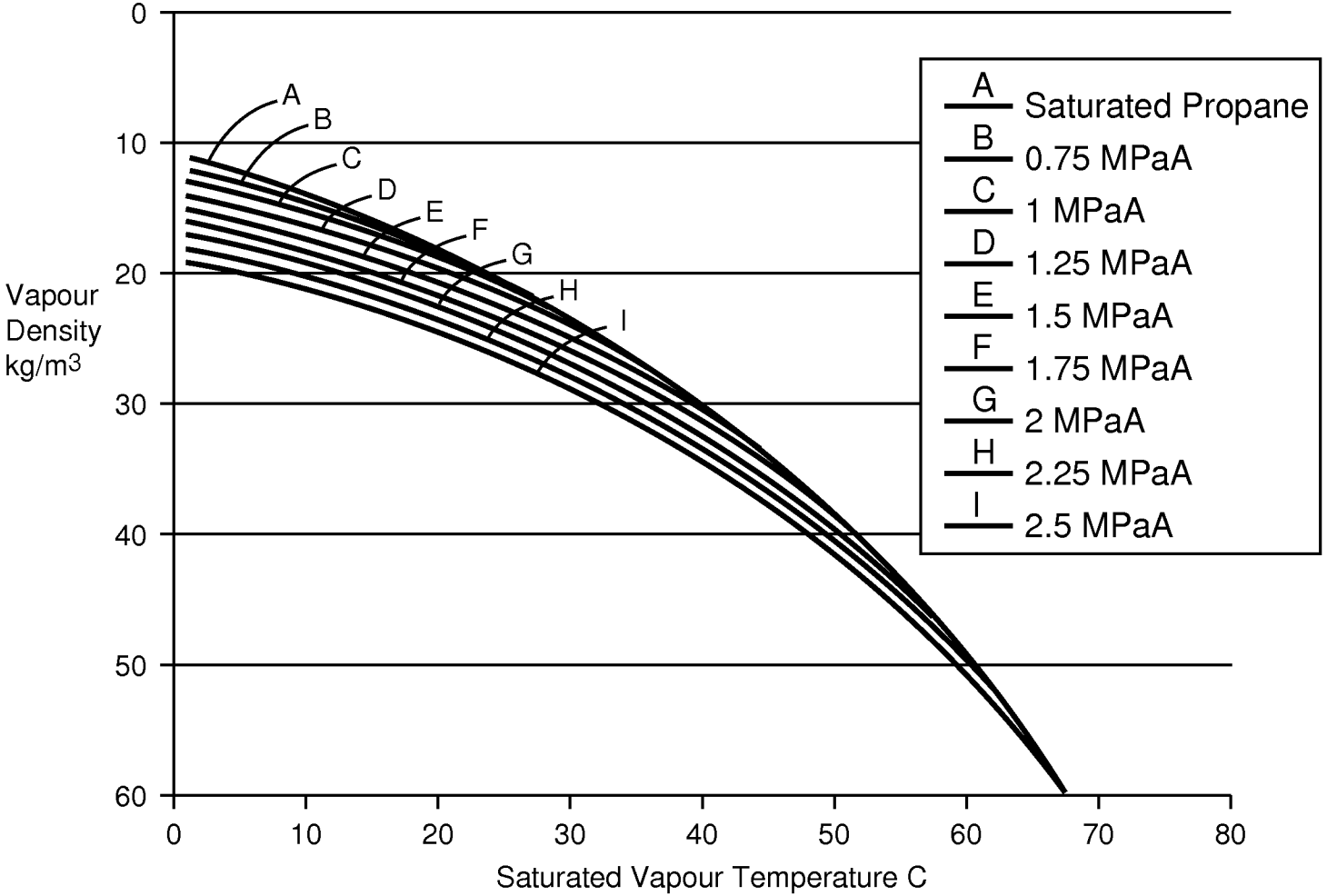
FIG. 8 shows a buoyancy curve of methane and hydrogen or a 1:1 ratio in propane at various pressures and saturation temperatures.

FIG. 7 shows the vapour density of various concentrations of methane in propane at various temperatures. FIG. 8 shows the vapour density of various concentrations of methane/hydrogen at 1:1 ratio in propane over a range of temperatures FIG. 7 shows the density of pure propane vapour as a function of saturation temperature. FIG. 7 also has a series of curves showing the density of saturated propane vapour at fixed pressures, ranging from 0.75 MPaA to 2.5 MPaA. In these curves, at fixed pressures, the saturation conditions are achieved by dilution of the propane vapour with a non-condensable gas, methane.

FIG. 8 is similar to FIG. 7, except than the non-condensable gas is a 50/50 mixture of methane and hydrogen instead of methane. The hydrogen vapour has a lower density that the methane so the 50/50 mix is more likely to rise than methane alone. Consequently the curves of FIG. 8 show lower density at a given temperature and pressure than the curves of FIG. 7.

As can now be appreciated from FIGS. 7 and 8 the barrier gas which is at the same pressure as the chamber, but at a lower temperature due to the non-condensable gas, has a vapour density which is less than that of pure propane vapour at the same pressure. This is relevant because this density difference provides a buoyancy driving force tending to float the barrier gas upwards towards the top of the chamber. Furthermore, the higher the accumulation of non-condensable gas (i.e. the lower the saturation temperature) in the barrier gas, the greater the buoyancy driving force.

Another aspect of the present invention is the convection flow rate of solvent through the chamber. If the solvent flow rate is very slow, diffusion forces can cause the non-condensable barrier gases to diffuse throughout the chamber and away from the condensation or extraction surfaces. However, providing that there is a sufficient flow of fresh condensing solvent gas flowing towards the condensing surfaces the diffusion effects will be mitigated. Thus, an aspect of the present invention is to maintain a sufficient flow of injection solvent through the chamber towards the extraction surfaces to overcome any diffusion effects that might otherwise encourage the barrier gases to diffuse through the chamber, and thus limit their effectiveness as a barrier gas. The exact rate will vary depending upon the chamber characteristics, but a flow rate of solvent that is higher than the diffusion rate of the barrier gas is most preferred.

To facilitate the operation of the present invention, it is desirable to know where the extraction interface which defines the extraction chamber is located. The present invention comprehends monitoring the movement of the extraction interface over time to ensure that the vertical growth of the chamber can be controlled. Various means of monitoring the extraction rate and the chamber growth can be used however, a preferred method according to the present invention is to position an observation well or wells in the formation at a location which is at or near a middle of said chamber (i.e., where the peak of the chamber roof will be). An example of such an observation well is shown as 70 in FIG. 6. The position of the observation well may be offset slightly from production and injection wells to reduce the risk of damage of one or the other during well drilling as shown in FIG. 6 or could be directly above, but not as deep as these wells. A logging tool 72 such as a reservoir saturation tool (RST) can be used to determine the nature of the material in the pores space (i.e., gas, water or hydrocarbon liquid). This tool can be used to periodically locate the roof of the vapour chamber. A temperature sensor 74 located within the observation well 70 can provide temperature measurements at specific locations or heights within the chamber.

Figure 9:
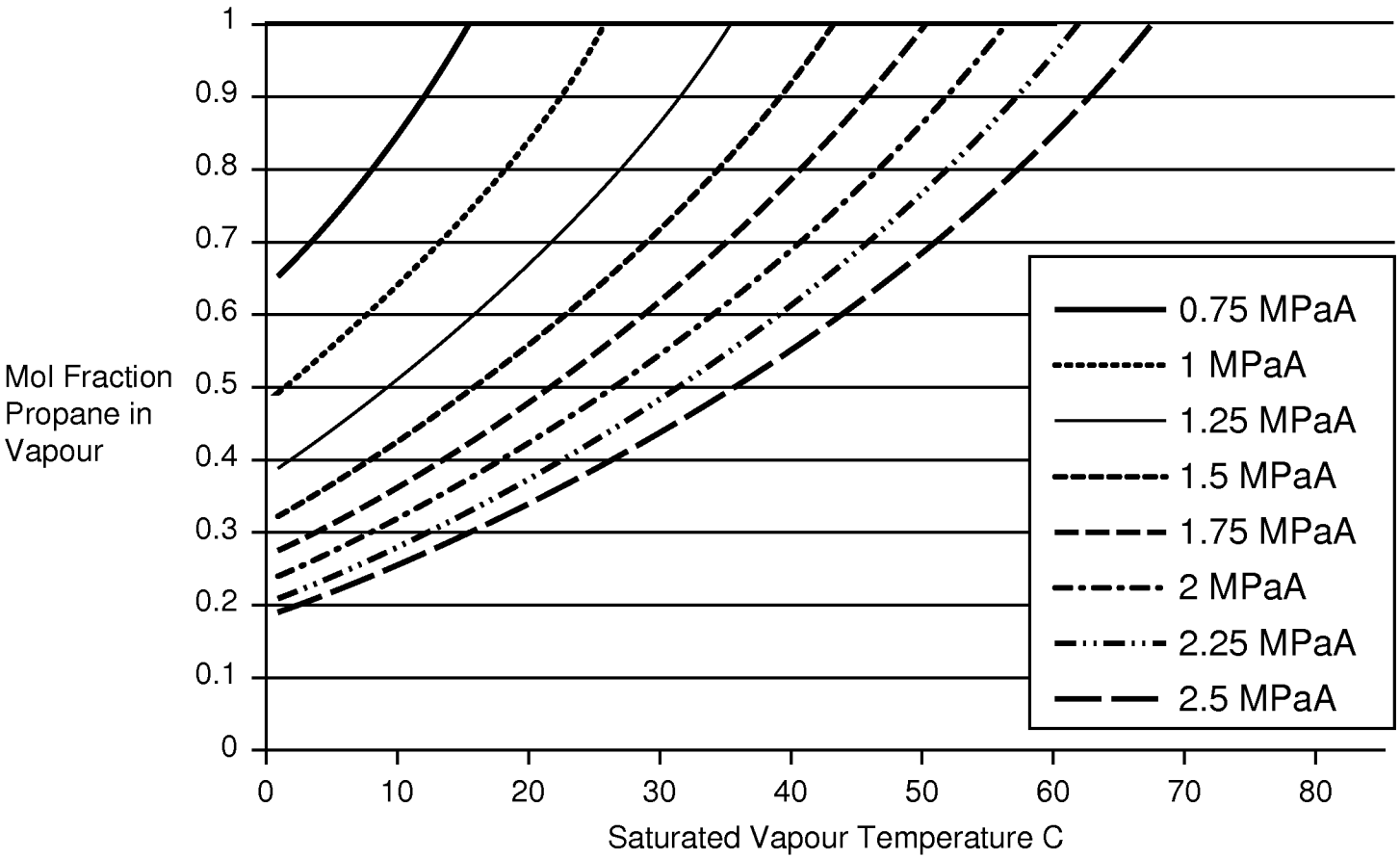
FIG. 9 shows the mol fraction of propane solvent in the saturated vapour as a function of chamber pressure and local temperature.

FIG. 9 shows the mol fraction of propane solvent in the saturated vapour as a function of temperature for various chamber pressures. The data of FIG. 9 can be used to relate the reduced temperatures within the barrier gas to the local concentration of propane solvent in the vapour. In this way, a real time vertical temperature profile can be used to calculate non condensable gas concentrations within the barrier gas blanket to determine its thickness and composition. This information can be used to monitor the gas blanket and relate the characteristics of the gas blanket to the vertical growth rate of the gravity drainage chamber. While this is the preferred method, the invention is not limited thereto and other methods of monitoring the chamber growth are also comprehended.

Prior to the extraction process being started, the position of the overburden layer will be identified. Then, it is a matter of monitoring a rise in temperature up the vertical column of the observation well or wells to monitor chamber growth.

In situations where the overburden is not capable of acting to confine the chamber, it will be desirable to maintain a pressure within the chamber at or slightly above formation pressure. This is to prevent leakage of fluid from the overburden layer of water into the chamber.

This invention comprehends that multiple adjustments to the solvent purity, may be necessary from time to time, to manage the barrier gas layer thickness and prevent it from thinning too much as the chamber grows horizontally. The horizontal growth of the chamber and/or removal of the barrier gas from the chamber via dissolution in the draining liquids would tend to thin the gas layer. By further adjustments to the solvent purity, it is possible to maintain the barrier layer to continue to restrict the upwards growth rate of the chamber and also reduce heat losses to the overburden.

In some cases the barrier layer may tend to be persistent in the attic region of the vapour chamber. This is because solvent condensation in the cooler region of the gas blanket will produce gas saturated liquid solvent. As this liquid drains down towards the bottom of the chamber, it will encounter warmer temperatures and consequently the non-condensable gas will be preferentially stripped out of the liquid. This non-condensable gas will then be returned to the gas blanket by convection movement of the injected condensing solvent in the gas phase.

It will be understood that as the chamber grows in size the heat losses to the overburden will increase and this has the effect of increasing the solvent to oil ratio. If the ability to recover and recycle the solvent is restricted, say by processing plant capacity, then it may not be feasible to maintain the chamber pressure at the desired pressure. In this situation, the use of a barrier layer to reduce overburden heat loss and consequently reduce solvent demand is desirable to allow the chamber pressure to be maintained at the preferred value.

It will be appreciated by those skilled in the art that while reference has been made to a preferred embodiment of the present invention above, various modifications and alterations can be made without departing from the broad spirit of the appended claims. Some of these variations have been discussed above and others will be apparent to those skilled in the art. What is desired according to the present invention is the use of a condensing solvent process to form an in situ gravity drainage chamber, where the chamber has a source of condensing fluid injection, a production means to remove extracted hydrocarbons and a system to monitor chamber growth and a means to preferentially accumulate barrier gas with the chamber. The precise choice of solvent and barrier gas can vary, provided that the barrier gas layer can be established where desired.

The invention claimed is:

1. A method of forming an in situ gravity drainage chamber while extracting hydrocarbons from a hydrocarbon bearing formation, the method comprising:

injecting a condensing solvent into said chamber to extract non-condensable gases from said chamber in liquid form;

monitoring a growth of said chamber in a vertical direction; and accumulating a non-condensable barrier gas in a layer at a top of said chamber by the further steps of a) stopping said condensing solvent injection, b) commencing barrier gas injection to establish the non-condensable barrier gas layer at said top of said chamber, c) stopping said non-condensable barrier gas injection, and d) restarting said condensing solvent injection below said non-condensable barrier gas layer to extend said growth of said chamber in a generally horizontal direction; wherein at in situ conditions said non-condensable barrier gas is less dense as compared to said condensing solvent, and said non-condensable barrier gas layer limits: (i) further vertical growth of said chamber at or before said chamber reaches an overburden layer; or (ii) further vertical heat flow from said chamber at or before said chamber reaches said overburden layer.

2. A method of forming an in situ gravity drainage chamber while extracting hydrocarbons from a hydrocarbon bearing formation as claimed in claim 1 wherein, when said condensing solvent is propane, said barrier gas is one or more of $H_2$, He, ethane or mixtures of the same.

3. A method of forming an in situ gravity drainage chamber while extracting hydrocarbons from a hydrocarbon bearing formation as claimed in claim 1 wherein barrier gas layer is sized and shaped to reduce heat losses from said chamber to said overburden layer.

4. A method of forming an in situ gravity drainage chamber while extracting hydrocarbons from a hydrocarbon bearing formation as claimed in claim 1 wherein said barrier gas layer is sized and shaped to restrict further vertical growth of said chamber at extraction conditions.

5. A method of forming an in situ gravity drainage chamber while extracting hydrocarbons from a hydrocarbon bearing formation as claimed in claim 1 wherein said solvent does not remove said barrier layer as a liquid from said chamber at extraction conditions.

6. A method of forming an in situ gravity drainage chamber while extracting hydrocarbons from a hydrocarbon bearing formation as claimed in claim 1 wherein said gravity drainage chamber is formed around a single generally vertical well.

7. A method of forming an in situ gravity drainage chamber while extracting hydrocarbons from a hydrocarbon bearing formation as claimed in claim 1 wherein said gravity drainage chamber is formed between and above two or more generally horizontal wells.

8. A method of forming an in situ gravity drainage chamber while extracting hydrocarbons from a hydrocarbon bearing formation as claimed in claim 1 wherein said step of establishing a barrier gas layer further comprises reducing said purity of said condensing solvent to permit non-condensable gas to accumulate in said chamber to form said barrier gas layer at or before said chamber reaches an overburden layer.

9. A method of forming an in situ gravity drainage chamber while extracting hydrocarbons from a hydrocarbon bearing formation as claimed in claim 8 wherein said step of reducing said purity of said condensing solvent comprises introducing a barrier gas into said chamber with said condensing solvent, wherein said barrier gas is less dense than said condensing solvent at a temperature and pressure of said chamber.

10. A method of forming an in situ gravity drainage chamber while extracting hydrocarbons from a hydrocarbon bearing formation as claimed in claim 8 wherein said step reducing a solvent purity of said condensing solvent is sufficient to allow barrier gases, naturally emitted from said hydrocarbons into said chamber from said hydrocarbons being produced, to accumulate in said barrier layer.

11. A method of forming an in situ gravity drainage chamber while extracting hydrocarbons from a hydrocarbon bearing formation as claimed in claim 1 wherein said gravity drainage chamber is formed between and above a generally horizontal well pair.

12. A method of forming an in situ gravity drainage chamber while extracting hydrocarbons from a hydrocarbon bearing formation, as claimed in claim 11 further including a step of measuring a temperature profile within said chamber, and estimating local barrier gas concentrations through said measured temperatures.

13. A method of forming an in situ gravity drainage chamber while extracting hydrocarbons from a hydrocarbon bearing formation, as claimed in claim 12 wherein a thickness of a gas blanket is determined by measuring a point at which the chamber temperature falls below a condensation temperature of said injected condensing solvent at a pressure equal to said chamber pressure.

14. A method of forming an in situ gravity drainage chamber while extracting hydrocarbons from a hydrocarbon bearing formation, as claimed in claim 1 wherein said step of monitoring a growth of said chamber in a vertical direction includes the step of locating an edge of said chamber by means of a reservoir saturation log.

15. A method of forming an in situ gravity drainage chamber while extracting hydrocarbons from a hydrocarbon bearing formation, as claimed in claim 14 wherein a growth rate of said chamber is measured by means of a change of temperature over time.

16. A method of forming an in situ gravity drainage chamber while extracting hydrocarbons from a hydrocarbon bearing formation, as claimed in claim 15 wherein said barrier gas is introduced in said chamber from one or both of said hydrocarbon being extracted and said condensing solvent being injected into said underground formation.

17. A method of forming an in situ gravity drainage chamber in a hydrocarbon bearing formation comprising injecting a condensing solvent into said formation and varying a solvent purity over time to cause enough of a non-condensable barrier gas to accumulate in a layer at a top of said chamber to preferentially restrict a growth of said chamber in a vertical direction; wherein said step of accumulating said non-condensable barrier gas in said chamber includes the steps of a) stopping said condensing solvent injection, b) commencing barrier gas injection to establish the non-condensable barrier gas layer at said top of said chamber, c) stopping said non-condensable barrier gas injection, and d) restarting said condensing solvent injection below said non-condensable barrier gas layer to extend said growth of said chamber in a generally horizontal direction; and wherein at in situ condition said non-condensable barrier gas is less dense as compared to said condensing solvent.

18. A method of forming an in situ gravity drainage chamber in a hydrocarbon bearing formation as claimed in claim 17 wherein said hydrocarbon bearing formation is in the form of a layer and including growing said chamber more in a horizontal direction than in a vertical direction to permit enhanced conformance of said chamber to said hydrocarbon bearing formation.

19. A method of limiting heat losses from a gravity chamber formed by condensing solvent extraction comprising the steps of: accumulating a layer of a barrier gas, which is non-condensable at the temperature and pressure of said chamber, at a top of extraction said chamber; wherein said step of accumulating said non-condensable barrier gas layer at said top of said chamber includes the steps of a) stopping condensing solvent injection, b) commencing barrier gas injection to establish the non-condensable barrier gas layer at said top of said chamber, c) stopping said non-condensable barrier gas injection, and d) restarting said condensing solvent injection below said non-condensable barrier gas layer to extend said growth of said chamber in a generally horizontal direction; and wherein at in situ condition said non-condensable barrier gas is less dense as compared to said condensing solvent.

20. A method of limiting heat losses from a gravity chamber formed by condensing solvent extraction as claimed in claim 19 wherein said reduced heat losses are sufficient to permit a reduced solvent to oil ratio to be attained in said process as compared to the same process without such a layer of gas.

21. A method of limiting heat losses from a gravity chamber formed by condensing solvent extraction as claimed in claim 19 wherein said reduced heat losses are sufficient to permit a higher chamber pressure and reduced solvent demand to be attained in said process as compared to the same process without such a layer of gas.

* * * * *